US010897796B2

(12) United States Patent
Iida et al.

(10) Patent No.: US 10,897,796 B2
(45) Date of Patent: Jan. 19, 2021

(54) INDUCTION HEATING COOKING APPARATUS

(71) Applicants: Mitsubishi Electric Corporation, Tokyo (JP); Mitsubishi Electric Home Appliance Co., Ltd., Saitama (JP)

(72) Inventors: Takeshi Iida, Tokyo (JP); Yuichiro Ito, Tokyo (JP); Hayato Yoshino, Tokyo (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 451 days.

(21) Appl. No.: 15/753,371

(22) PCT Filed: Oct. 23, 2015

(86) PCT No.: PCT/JP2015/079975
§ 371 (c)(1),
(2) Date: Feb. 19, 2018

(87) PCT Pub. No.: WO2017/068716
PCT Pub. Date: Apr. 27, 2017

(65) Prior Publication Data

US 2018/0242407 A1 Aug. 23, 2018

(51) Int. Cl.

| | |
|---|---|
| ***F24C 7/06*** | (2006.01) |
| ***F24C 7/08*** | (2006.01) |
| ***H05B 6/06*** | (2006.01) |

(Continued)

(52) U.S. Cl.
CPC ..... *H05B 6/1245* (2013.01); *H05B 1/0202* (2013.01); *H05B 1/0266* (2013.01);
(Continued)

(58) Field of Classification Search
CPC .. H05B 6/065; H05B 6/1236; H05B 2213/06; H05B 6/1245; H05B 6/062;
(Continued)

(56) References Cited

U.S. PATENT DOCUMENTS 5,746,114 A * 5/1998 Harris ..... F24C 7/082 99/331
6,080,972 A * 6/2000 May ..... A21B 1/02 219/486

(Continued)

FOREIGN PATENT DOCUMENTS

EP 3255958 A1 12/2017
JP 06-151051 A 5/1994

(Continued)

OTHER PUBLICATIONS

International Search Report of the International Searching Authority dated Nov. 17, 2015 for the corresponding International application No. PCT/JP2015/079975 (and English translation).

(Continued)

*Primary Examiner* — David J Walczak
(74) *Attorney, Agent, or Firm* — Posz Law Group, PLC

(57) ABSTRACT

An induction heating cooking apparatus capable of performing wireless communication with an external apparatus includes a heating unit that inductively heats an object to be heated and a driving circuit that outputs electric power to the heating unit. Electric power output from the driving circuit during a period of time in which the wireless communication with the external apparatus is performed is less than electric power output from the driving circuit during a period of time in which the wireless communication with the external apparatus is not performed.

16 Claims, 13 Drawing Sheets

(51) Int. Cl.
*H05B 6/12* (2006.01)
*H05B 1/02* (2006.01)

(52) U.S. Cl.
CPC ..... *H05B 6/062* (2013.01); *H05B 6/065* (2013.01); *H05B 6/1236* (2013.01); *F24C 7/067* (2013.01); *F24C 7/083* (2013.01); *H05B 2213/06* (2013.01)

(58) Field of Classification Search
CPC .... H05B 1/0202; H05B 1/0266; H05B 6/129; H05B 6/06; H05B 1/02; H05B 1/025; F24C 7/08; F24C 7/067; F24C 7/083
See application file for complete search history.

(56) References Cited

U.S. PATENT DOCUMENTS

| | | | | |
|---|---|---|---|---|
| 10,388,141 | B2 * | 8/2019 | Allen, Sr. ..... | A47J 36/00 |
| 2007/0221668 | A1 * | 9/2007 | Baarman ..... | H02J 50/00 219/746 |

FOREIGN PATENT DOCUMENTS

| | | | |
|---|---|---|---|
| JP | 10-160166 | A | 6/1998 |
| JP | 2002-106847 | A | 4/2002 |
| JP | 2002-289337 | A | 10/2002 |
| JP | 2009-087899 | A | 4/2009 |
| JP | 2012-146599 | A | 8/2012 |
| JP | 2014-202407 | A | 10/2014 |
| WO | 2016/125227 | A1 | 8/2016 |

OTHER PUBLICATIONS

Office action dated Apr. 28, 2020 issued in corresponding CN patent application No. 201580083895.2(and English machine translation thereof).

Office action dated Dec. 18, 2018 issued in corresponding JP patent application No. 2017-546371 (and English machine translation thereof).

* cited by examiner

INDUCTION HEATING COOKING APPARATUS

CROSS REFERENCE TO RELATED APPLICATION

This application is a U.S. national stage application of International Patent Application No. PCT/JP2015/079975 filed on Oct. 23, 2015, the disclosure of which is incorporated herein by reference.

TECHNICAL FIELD

The present invention relates to an induction heating cooking apparatus that heats, with electromagnetic induction, an object to be heated.

BACKGROUND

Conventionally, an operation unit that is set in an induction heating cooking apparatus main body receives selection of input heating power, that is, input electric power or selection of a cooking menu such as a water heating mode or a deep-frying mode. An output of an induction heating cooking apparatus is controlled according to a result of the received selection result.

On the other hand, for improvement of convenience, there have been developed a technology for remotely operating an output of an induction heating cooking apparatus through wireless communication using an external apparatus, and a technology for automatically controlling the output of the induction heating cooking apparatus through wireless communication in cooperation with other household electric appliances.

As an example, as disclosed in Patent Literature 1, there is a method of using a portable terminal having a wireless communication function as an external apparatus and controlling input electric power of an induction heating cooking apparatus through remote operation making use of wireless communication with the portable terminal.

PATENT LITERATURE

Patent Literature 1: Japanese Patent Application Laid-Open No. 2014-202407

An induction heating cooking apparatus generates a high-frequency magnetic flux with a heating coil set below a top plate and performs heating. At this time, a leaking magnetic flux is generated from the heating coil. Therefore, there is a problem in that, when electric power is input to the induction heating cooking apparatus by remote operation making use of wireless communication, the leaking magnetic flux interferes with a radio signal transmitted or received between the induction heating cooking apparatus and an external apparatus and the quality of the wireless communication is deteriorated.

SUMMARY

The present invention has been devised in view of the above, and an object of the present invention is to obtain an induction heating cooking apparatus that can suppress interference due to a leaking magnetic flux with a radio signal transmitted or received between the induction heating cooking apparatus and an external apparatus.

An induction heating cooking apparatus according to an aspect of the present invention is an induction heating cooking apparatus capable of performing wireless communication with an external apparatus including: a heating unit to inductively heat an object to be heated; and a driving circuit to output electric power to the heating unit. In the induction heating cooking apparatus, electric power output from the driving circuit during a first period is less than electric power output from the driving circuit during a second period. The first period is a period of time in which the wireless communication with the external apparatus is performed. The second period is a period of time in which the wireless communication with the external apparatus is not performed The induction heating cooking apparatus according to the present invention achieves an effect that it is possible to suppress interference due to a leaking magnetic flux with a radio signal for remote operation.

DETAILED DESCRIPTION

Induction heating cooking apparatuses according to embodiments of the present invention are explained in detail below with reference to the drawings. Note that the present invention is not limited by the embodiments.

First Embodiment

Figure 1:
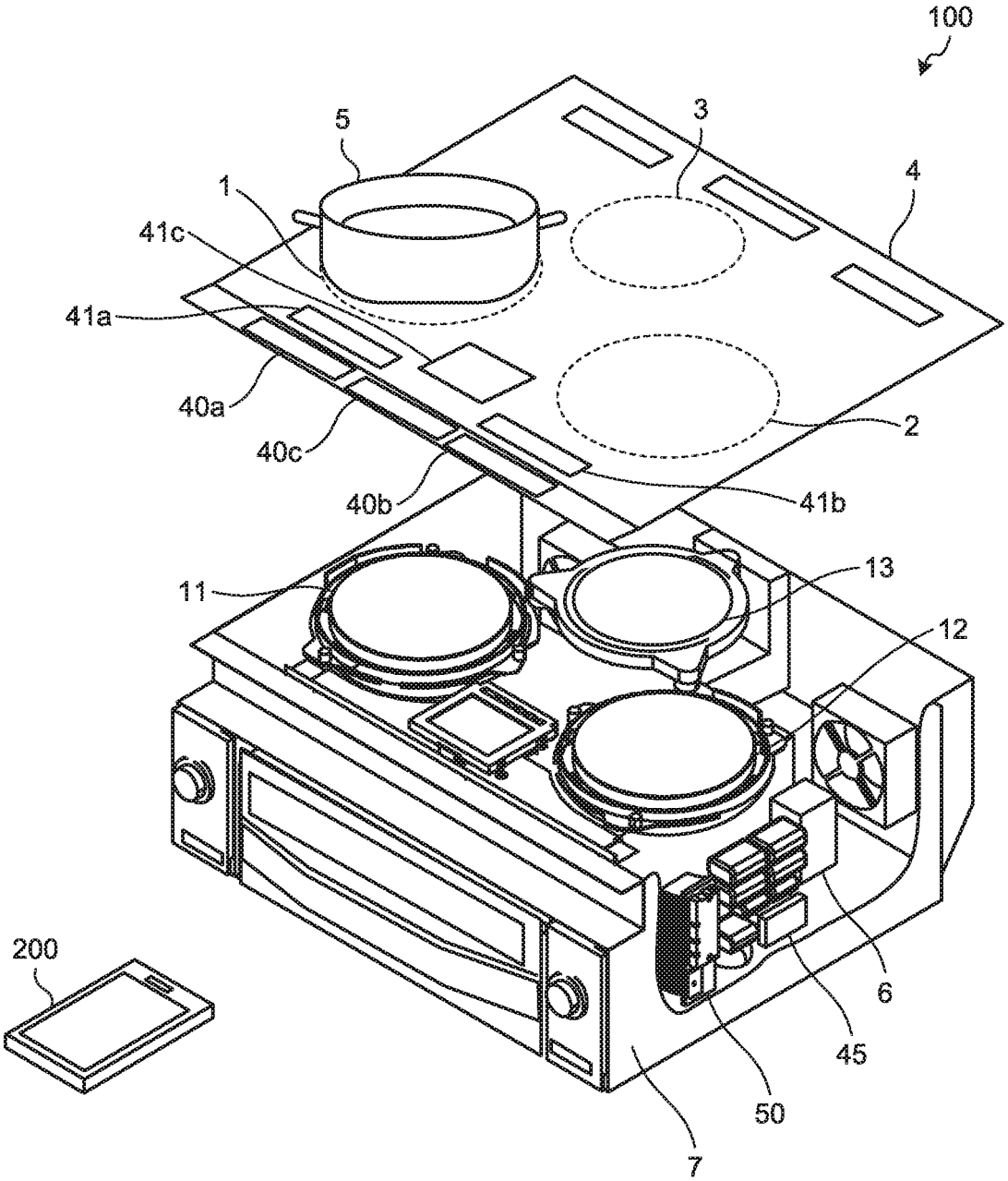
FIG. 1 is an exploded perspective view of an induction heating cooking apparatus according to a first embodiment.

FIG. 1 is an exploded perspective view of an induction heating cooking apparatus according to a first embodiment of the present invention. An induction heating cooking apparatus 100 in this embodiment is capable of communicating with an external apparatus 200 through wireless communication. As illustrated in FIG. 1, the induction heating cooking apparatus 100 in this embodiment includes a first heating unit 11, a second heating unit 12, and a third heating unit 13. The first heating unit 11, the second heating unit 12, and the third heating unit 13 are housed in a main body housing 7. The induction heating cooking apparatus 100 includes a top plate 4 on which an object to be heated 5 such as a pan can be placed. In the following explanation, the main body housing 7 and the units housed in the main body housing 7, that is, a portion excluding the top plate 4 in the induction heating cooking apparatus 100 is sometimes referred to as main body as well.

The top plate 4 includes a first heating port 1, a second heating port 2, and a third heating port 3 as heating ports for inductively heating an object to be heated, which is a metal load made of metal. The first heating port 1, the second heating port 2, and the third heating port 3 are provided in positions respectively corresponding to heating ranges of the first heating unit 11, the second heating unit 12, and the third heating unit 13. An object to be heated can be placed on each of the first heating port 1, the second heating port 2, and the third heating port 3. The object to be heated placed on each heating port is inductively heated by the heating unit corresponding to the heating port. In FIG. 1, an example is illustrated in which the object to be heated 5 is placed on the first heating port 1 of the top plate 4 as a load.

In the example illustrated in FIG. 1, the first heating unit 11 and the second heating unit 12 are provided side by side on the left and the right on a near side of the main body. The third heating unit 13 is provided substantially in the center on an inner side of the main body. Note that the near side is a side on which an operator is located when the operator uses the induction heating cooking apparatus 100 and is a lower left side on a paper surface of FIG. 1. Note that the disposition of the heating ports is not limited to this. For example, the three heating ports can be disposed laterally side by side in a substantially linear shape. The heating ports can be disposed such that positions in a depth direction of the center of the first heating unit 11 and the center of the second heating unit 12 are different. The three heating units are provided in the first embodiment. However, the number of heating units is not limited to three and can be one or two or can be four or more. Heating ports equivalent in number to the heating units are provided on the top plate 4.

The entire top plate 4 is made of a material that transmits an infrared ray such as heat resisting reinforced glass or crystallized glass. The top plate 4 is fixed in a water-tight state to an opening outer circumference of an upper surface of a main body housing 7 of the induction heating cooking apparatus 100 via a rubber gasket, a seal material, or a combination of the rubber gasket and the seal material. On the top plate 4, circular indications indicating a rough placing positions of objects to be heated, that is, pan position indications are formed by application of paint, printing, or the like in the heating ranges of the first heating unit 11, the second heating unit 12, and the third heating unit 13, that is, ranges indicating the heating ports, correspondingly.

On the top plate 4, an operation unit 40*a*, an operation unit 40*b*, and an operation unit 40*c* are provided as input devices, that is, receiving units for receiving setting of input heating power, that is, input electric power and a cooking menu when objects to be heated are heated by the first heating unit 11, the second heating unit 12, and the third heating unit 13. Examples of the cooking menu include a water heating mode and a deep-frying mode. Note that, in the following explanation, the operation unit 40*a*, the operation unit 40*b*, and the operation unit 40*c* are collectively referred to as an operation unit 40*a*, 40*b*, 40*c*. The operation unit 40*a*, the operation unit 40*b*, and the operation unit 40*c* are, for example, buttons, levers, or touch panels.

On the top plate 4, a display unit 41*a*, a display unit 41*b*, and a display unit 41*c* for displaying an operation state of the induction heating cooking apparatus 100, input information and control contents input from the operation unit 40*a*, 40*b*, 40*c* and the external apparatus 200, information concerning the external apparatus 200 that is performing wireless communication, presence or absence of the wireless communication, and the like are provided as informing means. That is, each of the display units 41*a*, 41*b*, and 41*c* displays at least one of information indicating the operation state of the induction heating cooking apparatus 100, setting information for the induction heating cooking apparatus 100, information based on a control signal received from the external apparatus 200, and information indicating a communication state between the induction heating cooking apparatus 100 and the external apparatus 200. The display unit 41*a*, the display unit 41*b*, and the display unit 41*c* are each configured by, for example, a liquid crystal monitor or a light emitting diode (LEDs). In the following explanation, the display unit 41*a*, the display unit 41*b*, and the display unit 41*c* are sometimes collectively referred to as a display unit 41*a*, 41*b*, 41*c*. Note that informing in this embodiment is not limited to only display by an image, characters, and the like and can include operation recognized by the operator with sound.

Note that, in the example illustrated in FIG. 1, the operation units 40*a* to 40*c* are correspondingly provided for the heating ports. Similarly, a display unit can be provided collectively for at least two or more of the heating ports. However, an operation unit can be provided collectively for at least two or more of the heating ports. A display operation unit functioning as both of the operation unit 40*a*, 40*b*, 40*c* and the display unit 41*a*, 41*b*, 41*c* can be provided. Specific configurations of the operation unit and the display unit are not particularly limited.

As explained above, the first heating unit 11, the second heating unit 12, and the third heating unit 13 are provided below the top plate 4 and on the inside of the main body housing 7. Each of the heating units is made of a heating coil.

Further, on the inside of the main body housing 7 of the induction heating cooking apparatus 100, a driving unit 50 that supplies electric power to the heating coils of the first heating unit 11, the second heating unit 12, and the third heating unit 13, a control unit 45 for controlling the operation of the entire induction heating cooking apparatus 100 including the driving unit 50, and a communication unit 6 that executes wireless communication between the induction heating cooking apparatus 100 and the external apparatus 200 are provided.

The heating coils configuring the first heating unit 11, the second heating unit 12, and the third heating unit 13 have a substantially circular plane shape and are configured by winding a conductive wire made of insulatively coated any metal in a circumferential direction. As the metal forming the heating coils, for example, copper, aluminum, and the like can be used. In the induction heating cooking apparatus 100, high-frequency electric power is supplied to the heating coils by the driving unit 50, whereby an induction heating operation is performed.

Figure 2:
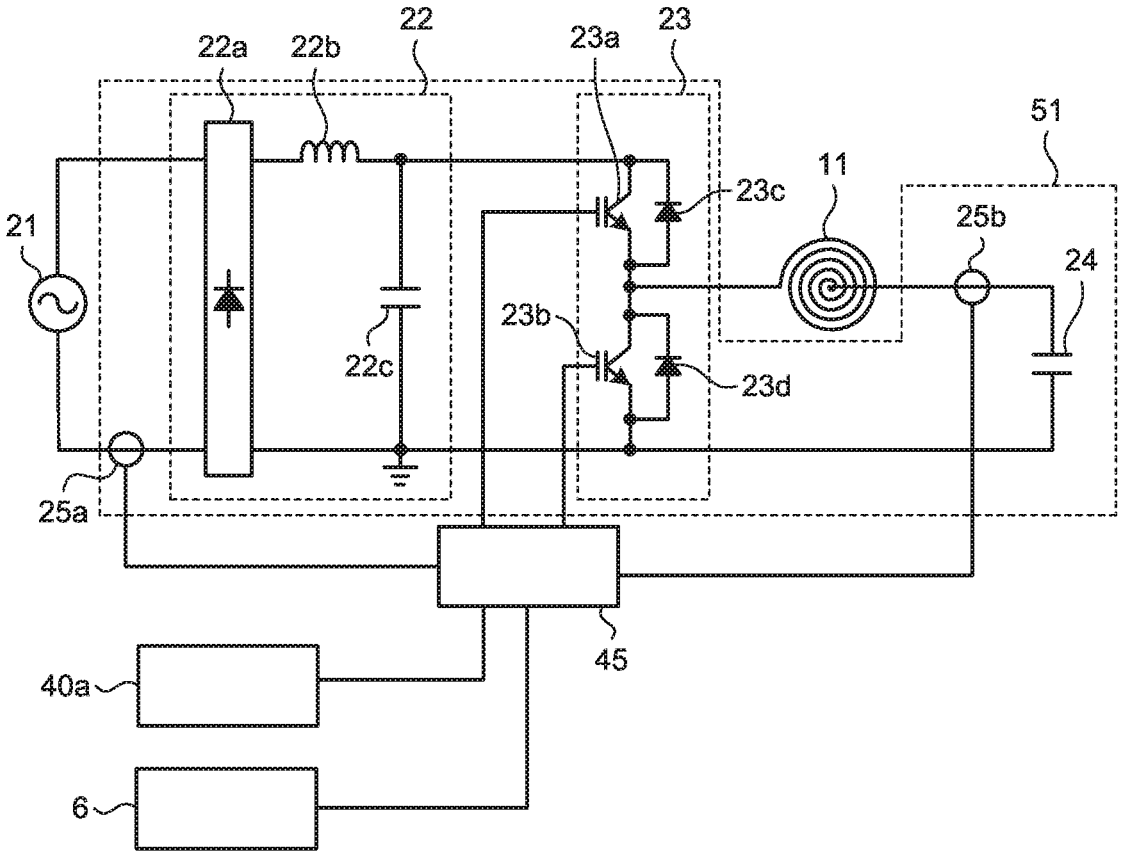
FIG. 2 is a diagram illustrating a configuration example of a driving circuit of the induction heating cooking apparatus according to the first embodiment.

The driving unit 50 includes three driving circuits 51 each of which corresponds to one of the heating units. FIG. 2 is a diagram illustrating a configuration example of the driving circuit 51 of the induction heating cooking apparatus 100 according to the first embodiment. In FIG. 2, a configuration example of the driving circuit 51 corresponding to the first heating unit 11 is illustrated. Note that, driving circuits corresponding to the heating units can be the same or can be different for each of the heating units.

The driving circuit 51 includes, as illustrated in FIG. 2, a direct-current power supply circuit 22, an inverter circuit 23, a resonant capacitor 24, an input-current detecting unit 25*a*, and an output-current detecting unit 25*b*.

The input-current detecting unit 25*a* detects an electric current input to the direct-current power supply circuit 22 from an alternating-current power supply circuit 21, that is, an electric current input to the driving circuit 51 and outputs a voltage signal indicating a detected value, that is, an input current value to the control unit 45. The alternating-current power supply circuit 21 is, for example, a commercial alternating-current power supply circuit.

The direct-current power supply circuit 22 includes a diode bridge 22*a*, a reactor 22*b*, and a smoothing capacitor 22*c*. The direct-current power supply circuit 22 converts an alternating-current voltage input from the alternating-current power supply circuit 21 into a direct-current voltage and outputs the direct-current voltage to the inverter circuit 23.

The inverter circuit 23 is an inverter of a so-called half-bridge type in which insulated gate bipolar transistors (IGBTs) 23*a* and 23*b* functioning as switching elements are connected to an output of the direct-current power supply circuit 22 in series. In the inverter circuit 23, diodes 23*c* and 23*d* are respectively connected in parallel to the IGBTs 23*a* and 23*b* as flywheel diodes. The inverter circuit 23 converts direct-current electric power output from the direct-current power supply circuit 22 into high-frequency alternating-current electric power of approximately 20 kilohertz to 80 kilohertz, that is, so-called high-frequency electric power and supplies the high-frequency electric power to a resonant circuit configured by the first heating unit 11, which is a heating coil, and the resonant capacitor 24.

The resonant capacitor 24 is connected to the first heating unit 11 in series. The resonant circuit has a resonant frequency corresponding to the inductance of the first heating unit 11, the capacitance of the resonant capacitor 24, and the like. Note that the inductance of the first heating unit 11 changes according to a characteristic of a metal load at the time when the object to be heated 5, which is the metal load, is magnetically coupled. The resonant frequency of the resonant circuit changes according to the change in the inductance.

With such a configuration, a high-frequency electric current of approximately several ten amperes flows to the first heating unit 11. The object to be heated 5 placed on the top plate 4 immediately above the first heating unit 11 is inductively heated by a high-frequency magnetic flux generated by the flowing high-frequency electric current. The IGBTs 23*a* and 23*b*, which are the switching elements, are configured by, for example, a semiconductor made of silicon. However, the IGBTs 23*a* and 23*b* can be configured using a wide band gap semiconductor such as a silicon carbide or gallium nitride-based material.

By using the wide band gap semiconductor in the switching elements, it is possible to reduce an energization loss of the switching elements. Even if a switching frequency, that is, a driving frequency is set to a high frequency, that is, switching is performed at high speed, heat radiation of the driving unit 50 is satisfactory. Therefore, it is possible to reduce a heat radiation fin of the driving unit 50 in size. It is possible to realize a reduction in the size and a reduction in the cost of the driving unit 50.

The output-current detecting unit 25*b* is connected to the resonant circuit configured by the first heating unit 11 and the resonant capacitor 24. For example, the output-current detecting unit 25*b* detects an electric current flowing to the first heating unit 11, that is, an electric current output from the driving circuit 51 and outputs a voltage signal equivalent to a detected value to the control unit 45.

Figure 3:
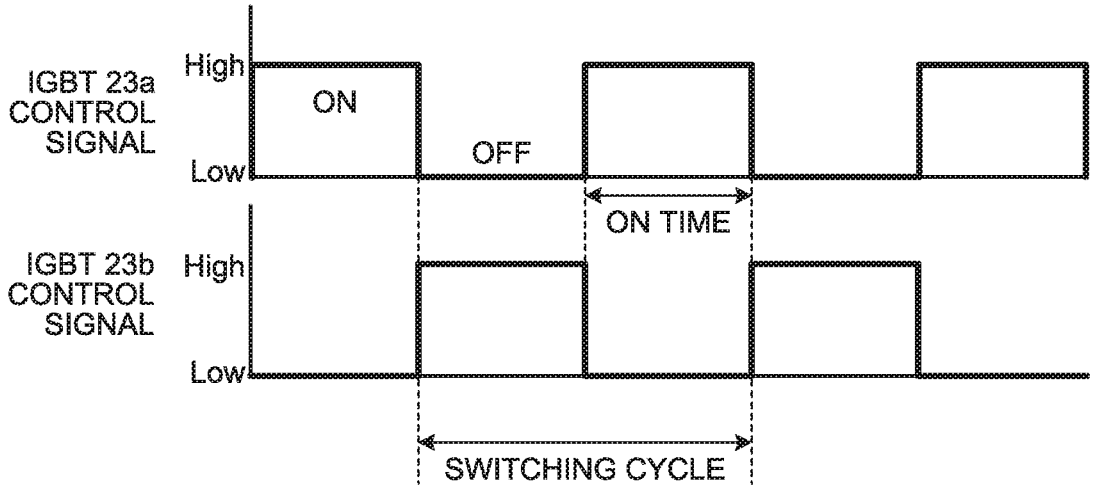
FIG. 3 is a diagram illustrating an example of control signals input to an IGBT in the first embodiment from a control unit.

FIG. 3 is a diagram illustrating an example of control signals input to the IGBTs 23*a* and 23*b* from the control unit 45. Regarding the control signals for the IGBTs 23*a* and 23*b*, each control signal indicates, for example, either one value of a value indicating that the transistor is turned on and a value indicating that the transistor is turned off. In the example illustrated in FIG. 3, High of the signal value of the control signals indicates ON and Low of the signal value of the control signals indicates OFF. However, a relation between the values of the control signals and ON/OFF regarding the IGBTs 23*a* and 23*b* is not limited to this example. The IGBTs 23*a* and 23*b* are turned on and turned off at a repetitive cycle called switching cycle. Each of an ON time and an OFF time is half the time of the switching cycle. As illustrated in FIG. 3, a phase difference of 180° is provided for turning-on timing between the IGBT 23*a* and the IGBT 23*b*. Consequently, the IGBT 23*a* and the IGBT 23*b* are not simultaneously turned on.

When the switching cycle is shortened, a switching frequency, which is the inverse of the switching cycle, increases and the impedance of the first heating unit 11 increases. Therefore, a high-frequency electric current supplied by the driving circuit 51 decreases and output electric power is reduced. Conversely, when the switching cycle is lengthened, the switching frequency decreases and the impedance of the first heating unit 11 decreases. Therefore, the high-frequency electric current supplied by the driving circuit 51 increases and the output electric power increases. In the control method explained above, the output electric power is controlled by the level of the switching frequency. Therefore, the control method is called switching frequency control or pulse frequency control. Note that, when the IGBT 23*a* and the IGBT 23*b* are simultaneously turned on, the inverter circuit 23 is short-circuited. Therefore, in an actual circuit, a period of time called dead time when both of the IGBTs 23*a* and 23*b* are turned off is provided.

Therefore, the ON time is shorter than the half time of the switching cycle and the OFF time is longer than the half time of the switching cycle.

Figure 4:
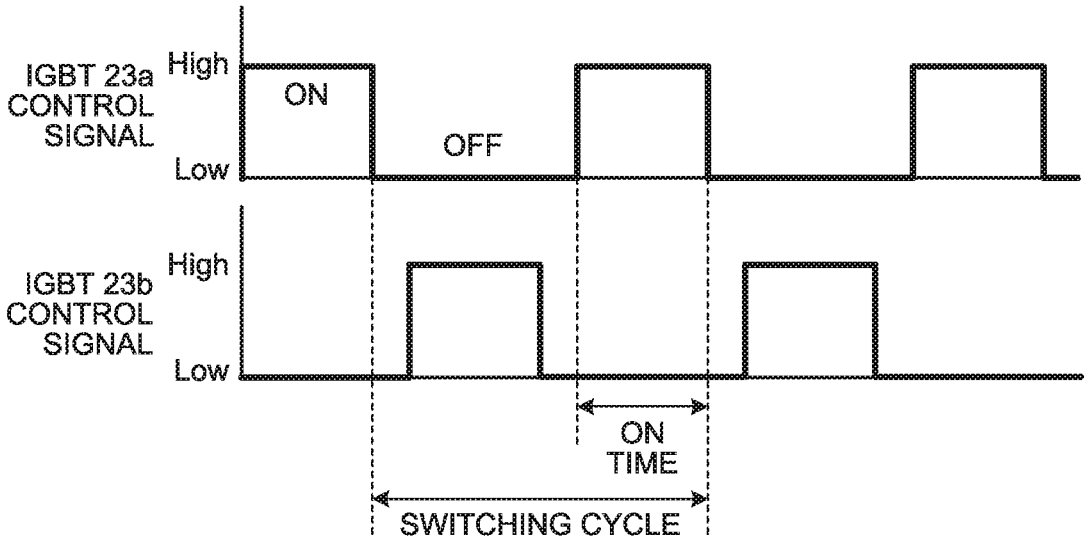
FIG. 4 is a diagram illustrating another example of the control signals input to the IGBT in the first embodiment from the control unit.

FIG. 4 is a diagram illustrating another example of the control signals for controlling ON/OFF of the IGBTs 23*a* and 23*b*. As in the example illustrated in FIG. 3, regarding the control signals for the IGBTs 23*a* and 23*b*, each signal indicates either one value of a value indicating that the transistor is turned on and a value indicating that the transistor is turned off. As in the example illustrated in FIG. 3, the IGBTs 23*a* and 23*b* are turned on/off at a repetitive cycle called switching cycle. As in the example illustrated in FIG. 3, a phase difference of 180° is provided for turning-on timing between the IGBT 23*a* and the IGBT 23*b*. Therefore, the IGBT 23*a* and the IGBT 23*b* are not simultaneously turned on.

In the example illustrated in FIG. 4, unlike the example illustrated in FIG. 3, the ON time is a time shorter than a half of the switching cycle. When both of the IGBTs 23*a* and 23*b* are off, the inverter circuit 23 does not output electric power. Therefore, when the ON time is shortened, the high-frequency electric current supplied to the first heating unit 11 by the driving circuit 51 decreases and the output electric power is reduced. A ratio of the ON time to the switching cycle is called duty ratio. In the control method explained above, the output electric power is controlled using the duty ratio. Therefore, the control method is called duty ratio control. In the example illustrated in FIG. 4, the duty ratio is small compared with the example illustrated in FIG. 3. Therefore, the output electric power from the driving circuit 51 is small compared with the example illustrated in FIG. 3.

Figure 5:
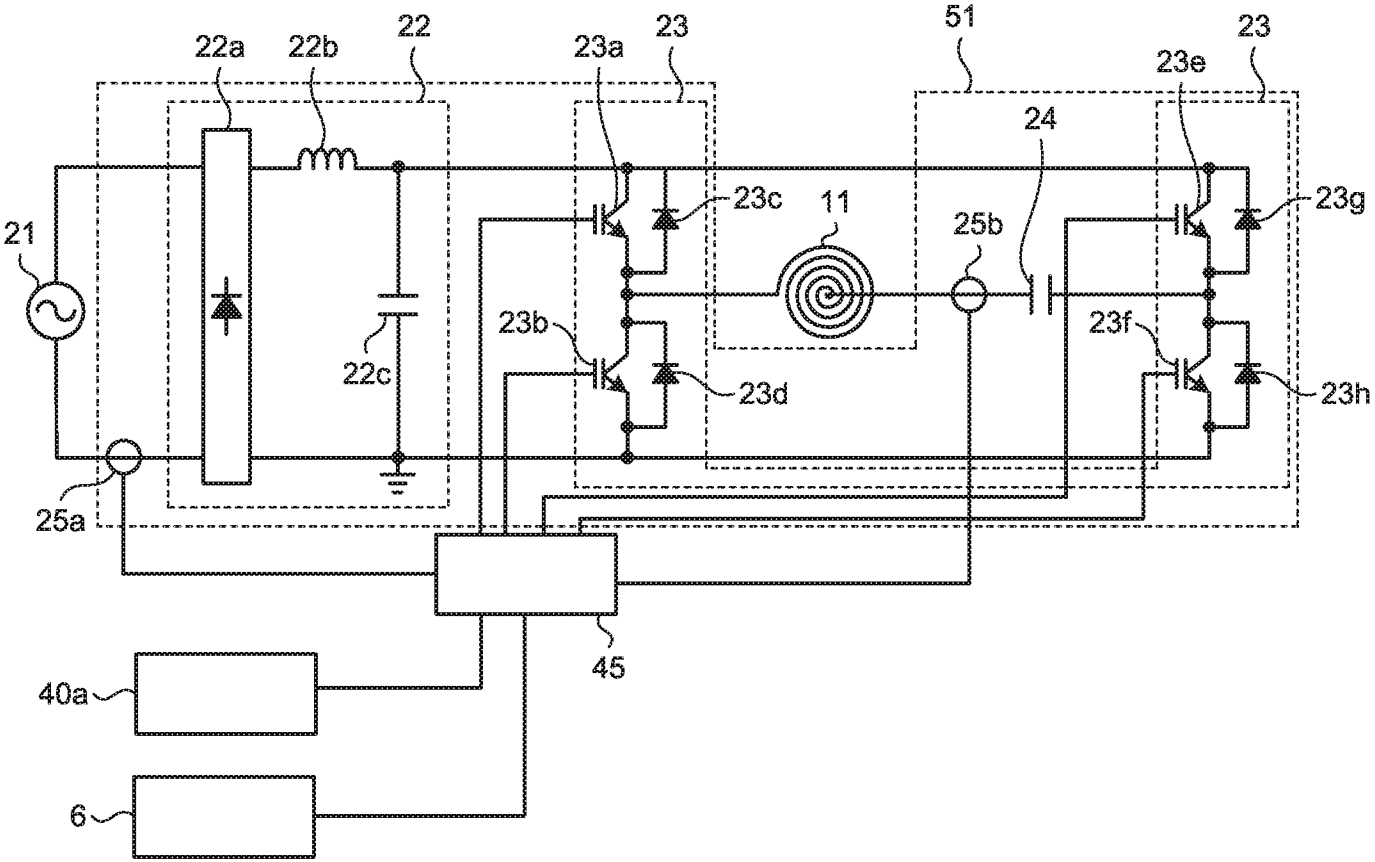
FIG. 5 is a diagram illustrating an example of another driving circuit of the induction heating cooking apparatus according to the first embodiment.

FIG. 5 is a diagram illustrating an example of another driving circuit 51 of the induction heating cooking apparatus 100 according to the first embodiment. In FIG. 5, the same components as the components illustrated in FIG. 2 are denoted by the same reference numerals and sings as the reference numerals and signs in FIG. 2. A configuration example illustrated in FIG. 5 is a configuration in which IGBTs 23*e* and 23*f* functioning as switching elements and diodes 23*g* and 23*h* functioning as flywheel diodes are added to the driving circuit 51 illustrated in FIG. 2. The inverter circuit 23 illustrated in FIG. 5 has a configuration in which the IGBTs 23*e* and 23*f* and the diodes 23*g* and 23*h* are added to the inverter circuit 23 illustrated in FIG. 2 and is an inverter of a so-called full-bridge type. Like the inverter circuit 23 illustrated in FIG. 2, the inverter circuit 23 illustrated in FIG. 5 converts the direct-current electric power output from the direct-current power supply circuit 22 into high-frequency alternating-current electric power of approximately 20 kilohertz to 80 kilohertz and supplies the high-frequency alternating-current electric power to the resonant circuit configured by the first heating unit 11 and the resonant capacitor 24.

Figure 6:
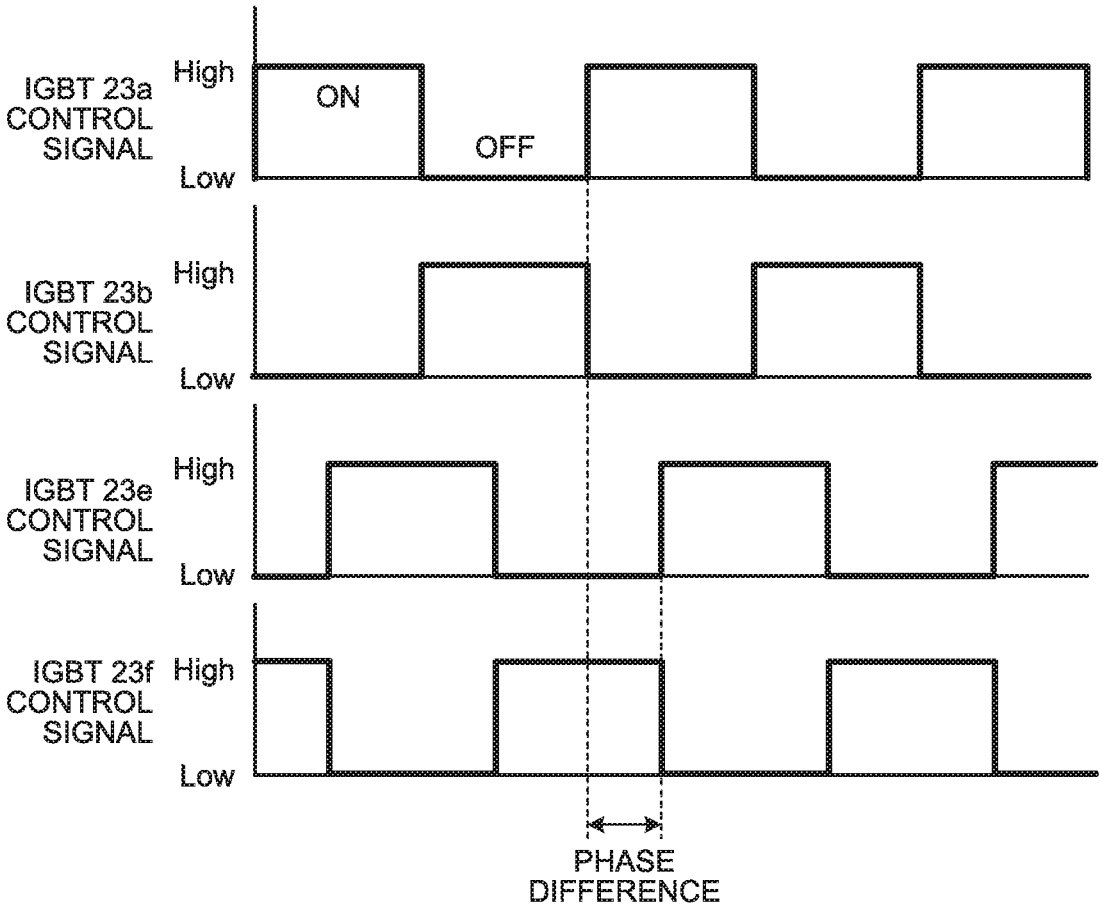
FIG. 6 is a diagram illustrating an example of control signals for controlling ON/OFF of an IGBT illustrated in FIG. 5 in the first embodiment.

FIG. 6 is a diagram illustrating an example of control signals for controlling ON/OFF of the IGBTs 23*a*, 23*b*, 23*e*, and 23*f* illustrated in FIG. 5. Each of the IGBTs 23*a*, 23*b*, 23*e*, and 23*f* is turned on and turned off at a repetitive cycle called switching cycle. Each of an ON time and an OFF time is half the time of the switching cycle. A phase difference of 180° is provided for turning-on timing between the IGBT 23*a* and the IGBT 23*b*. Consequently, the IGBT 23*a* and the IGBT 23*b* are not simultaneously turned on. A phase difference of 180° is provided for turning-on timing between the IGBT 23*e* and the IGBT 23*f*. Consequently, the IGBT 23*e* and the IGBT 23*f* are not simultaneously turned on.

In a period of time in which both of the IGBT 23*a* and the IGBT 23*f* or both of the IGBT 23*b* and the IGBT 23*e* are on, the inverter circuit 23 supplies electric power. The phase difference is provided between timing when the IGBT 23*a* is turned on and timing when the IGBT 23*e* is turned on to provide the period of time in which both of the IGBT 23*a* and the IGBT 23*f* or both of the IGBT 23*b* and the IGBT 23*e* are turned on and control electric power supplied by the inverter circuit 23. In the control method explained above, the output electric power is controlled by the phase difference. Therefore, the control method is called phase control. Note that, when both of the IGBT 23*a* and the IGBT 23*b* or both of the IGBT 23*e* and the IGBT 23*f* are simultaneously turned on, the inverter circuit 23 is short-circuited. Therefore, in an actual circuit, a period of time in which both of the IGBT 23*a* and the IGBT 23*b* are turned off and a period of time in which both of the IGBT 23*e* and the IGBT 23*f* are turned off are provided. Therefore, the ON time is shorter than half the time of the switching cycle and the OFF time is longer than half the time of the switching cycle.

Note that the configuration of the driving circuit 51 of the induction heating cooking apparatus 100 according to the first embodiment is not limited to the examples illustrated in FIG. 2 and FIG. 5. For example, the driving circuit 51 can also be configured by a circuit system such as a single transistor voltage resonant circuit. Like the inverter circuit 23 illustrated in FIG. 2, the single transistor voltage resonant circuit converts direct-current electric power output from the direct-current power supply circuit 22 into high-frequency alternating-current electric power of approximately 20 kilohertz to 80 kilohertz and supplies the high-frequency alternating-current electric power to the resonant circuit configured by the first heating unit 11 and the resonant capacitor 24.

The control unit 45 transmits, according to signals given from the input-current detecting unit 25*a*, the output-current detecting unit 25*b*, the operation unit 40*a*, and the communication unit 6, a control signal for controlling high-frequency electric power supplied to the first heating unit 11, the second heating unit 12, and the third heating unit 13 by the driving unit 50.

The control unit 45 transmits control signals for informing an operation state of the induction heating cooking apparatus 100, input information from the operation unit 40*a*, 40*b*, 40*c* and the external apparatus 200, control content, and the like to the communication unit 6.

The communication unit 6 is wireless communication means for performing wireless communication with the external apparatus 200. The communication unit 6 can transmit and receive radio signals. Specifically, the communication unit 6 can apply transmission processing corresponding to a communication system between the induction heating cooking apparatus 100 and the external apparatus 200 to a control signal received from the control unit 45, and transmit the control signal to the external apparatus 200 as a radio signal. Alternatively, the communication unit 6 can receive a control signal transmitted from the external apparatus 200 as a radio signal, extract the control signal from the radio signal, and transmit the control signal to the control unit 45. Alternatively, the communication unit 6 can perform both operations of the transmitting operation of the radio signal and the receiving operation of the radio signal. The communication unit 6 transmits at least one of information indicating an operation state of the induction heating cooking apparatus 100, setting information for the induction heating cooking apparatus 100, and information based on a control signal received from the external apparatus 200 to the external apparatus 200.

The communication unit 6 is connected to the control unit 45 by a wire. However, as the wire is longer, the wire is more easily affected by noise. Therefore, it is desirable to dispose the communication unit 6 and the control unit 45 close to each other and reduce the length of the wire that connects the communication unit 6 and the control unit 45.

The communication unit 6 includes, on the inside, an antenna unit that transmits or receives or transmits and receives radio signals. To more easily transmit and receive the radio signals, it is desirable to dispose the antenna unit of the communication unit 6 to be present immediately below the top plate 4.

Note that the control unit 45 is realized by a processing circuit. The processing circuit can be dedicated hardware or can be a control circuit including a memory and a central processing unit (CPU; also referred to as central processing device, processing device, arithmetic operation device, microprocessor, microcomputer, processor, and digital signal processor (DSP)) that executes a program stored in the memory. The memory corresponds to, for example, a non-volatile or volatile semiconductor memory such as a random access memory (RAM), a read only memory (ROM), a flash memory, an erasable programmable read only memory (EPROM), or an electrically erasable programmable read only memory (EEPROM), a magnetic disk, a flexible disk, an optical disk, a compact disc, a minidisc, or a digital versatile disk (DVD).

Figure 7:
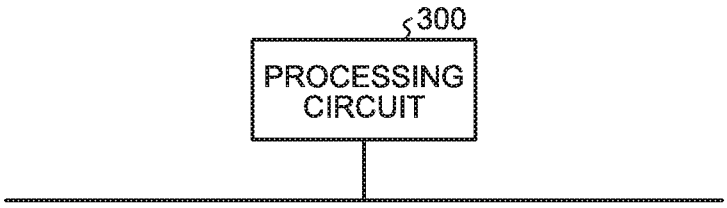
FIG. 7 is a diagram illustrating a configuration example of a processing circuit in the first embodiment.

When the control unit 45 is realized by the dedicated hardware, the dedicated hardware is realized by a processing circuit 300 illustrated in FIG. 7. The processing circuit 300 is, for example, a single circuit, a composite circuit, a programmed processor, a parallel-programmed processor, an application specific integrated circuit (ASIC), a field programmable gate array (FPGA), or a combination of the forgoing.

Figure 8:
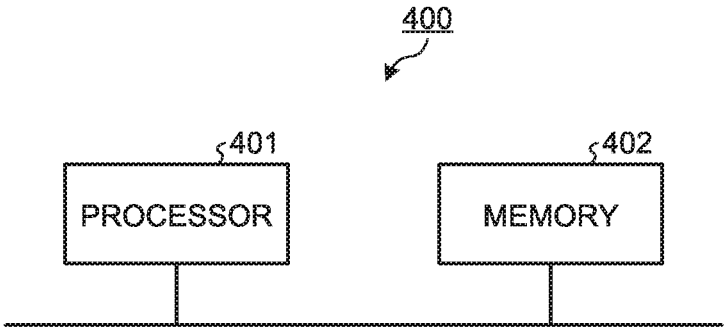
FIG. 8 is a diagram illustrating a configuration example of a control circuit in the first embodiment.

When the control unit 45 is realized by the control circuit including the CPU, the control circuit is, for example, a control circuit 400 having a configuration illustrated in FIG. 8. As illustrated in FIG. 8, the control circuit 400 includes a processor 401, which is a CPU, and a memory 402. When the control unit 45 is realized by the control circuit 400, the control unit 45 is realized by the processor 401 reading out and executing a program corresponding to processing of the control unit 45 stored in the memory 402. The memory 402 is also used as a temporary memory for kinds of processing carried out by the processor 401.

The external apparatus 200 is an apparatus capable of performing wireless communication such as a smartphone. The external apparatus 200 has a function of transmitting, through wireless communication, a control signal for setting input heating power and a cooking menu at the time when the induction heating cooking apparatus 100 heats an object to be heated.

Figure 9:
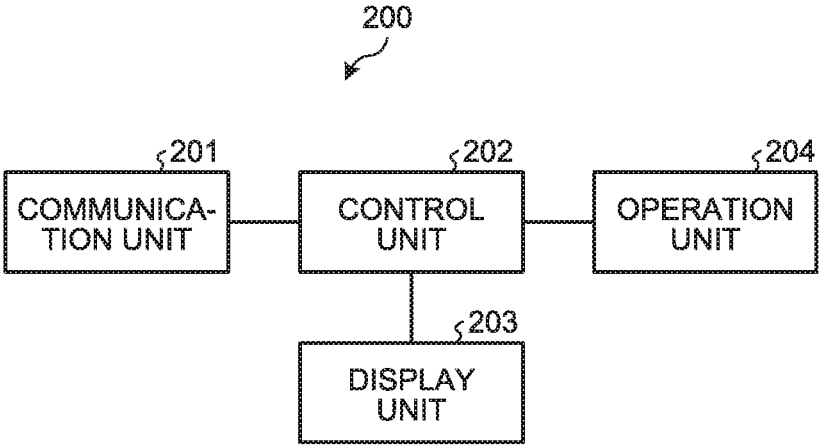
FIG. 9 is a diagram illustrating a configuration example of an external apparatus in the first embodiment.

FIG. 9 is a diagram illustrating a configuration example of the external apparatus 200. As illustrated in FIG. 9, the external apparatus 200 includes a communication unit 201, a control unit 202, a display unit 203, and an operation unit 204. The communication unit 201 performs wireless communication. The control unit 202 controls the entire operation of the external apparatus 200. The display unit 203 displays, according to an instruction from the control unit 202, an image, characters, and the like for informing to an operator of the external apparatus 200. The display unit 203 is configured by, for example, a liquid crystal monitor. The operation unit 204 is an input device, that is, a receiving unit that receives an input from the operator of the external apparatus 200. The operation unit 204 is, for example, a touch panel, buttons, or switches. The display unit 203 and the operation unit 204 can be integrally configured.

When receiving, from the operator, indication that the induction heating cooking apparatus 100 is to be operated, the control unit 202 instructs the display unit 203 to display a screen for receiving input information for operating the induction heating cooking apparatus 100. The display unit 203 displays, according to the instruction from the control unit 202, the screen for receiving the input information for operating the induction heating cooking apparatus 100. The operator inputs the input information by operating the operation unit 204 on the basis of the displayed screen. For example, the display unit 203 displays an image showing a cooking menu such as a water heating mode and a deep-frying mode. The operator selects one of the displayed modes with the operation unit 204. The operation unit 204 notifies the mode selected by the operator to the control unit 202. The control unit 202 generates a control signal indicating the mode notified from the operation unit 204 and outputs the control signal to the communication unit 201. The communication unit 201 transmits the input control signal to the induction heating cooking apparatus 100 as a radio signal.

When receiving an input of input heating power from the operator, similarly, the external apparatus 200 displays the screen for receiving operation on the display unit 203 and receives, with the operation unit 204, an input of information indicating the input heating power. The control unit 202 generates a control signal indicating the input heating power and outputs the control signal to the communication unit 201. The communication unit 201 transmits the input control signal to the induction heating cooking apparatus 100 as a radio signal. Concerning a heating start and a heating stop of the induction heating cooking apparatus 100, similarly, the external apparatus 200 receives an input from the operator with the operation unit 204.

When receiving a radio signal transmitted from the induction heating cooking apparatus 100, the communication unit 201 extracts information from the received signal and inputs the extracted information to the control unit 202. The control unit 202 instructs the display unit 203 to display the input information. The display unit 203 displays the information on the basis of the instruction from the control unit 202. The information included in the radio signal transmitted from the induction heating cooking apparatus 100 is, for example, information indicating an operation state of the induction heating cooking apparatus 100.

The control unit 202 is realized by a processing circuit. The processing circuit can be dedicated hardware or can be a control circuit including a CPU. When the control unit 202 is realized by the dedicated hardware, the processing circuit is, for example, the processing circuit 300 illustrated in FIG. 7. When the control unit 202 is realized by the control circuit including the CPU, the control circuit is, for example, the control circuit 400 illustrated in FIG. 8.

In the above explanation, the example is explained in which the external apparatus 200 performs both of the reception of the radio signal transmitted from the induction heating cooking apparatus 100 and the transmission of the radio signal to the induction heating cooking apparatus 100.

Figure 10:
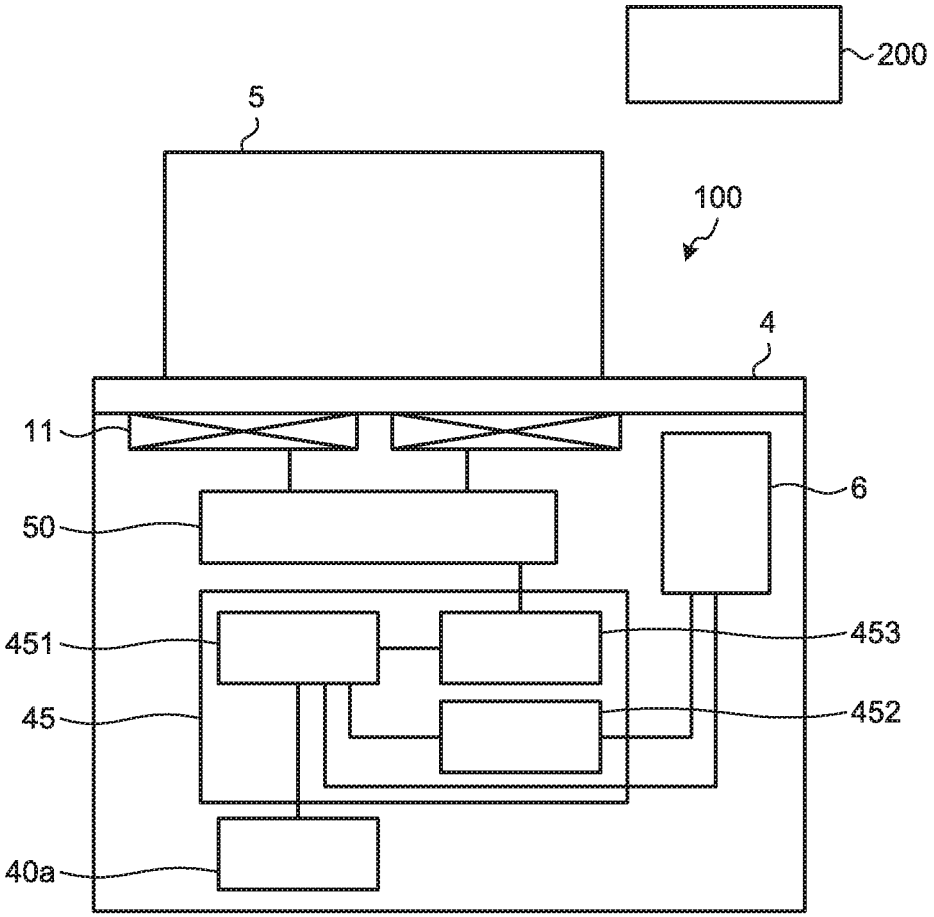
FIG. 10 is a diagram illustrating a configuration example of a control unit of the induction heating cooking apparatus according to the first embodiment.

The operation of the induction heating cooking apparatus 100 according to the first embodiment is explained. FIG. 10 is a diagram illustrating a configuration example of the control unit 45 of the induction heating cooking apparatus 100 according to the first embodiment. In FIG. 10, the first heating unit 11 and components related to control of the first heating unit 11 in the induction heating cooking apparatus 100 are illustrated. Illustration of the second heating unit 12 and the third heating unit 13 and components related to control of the second heating unit 12 and the third heating unit 13 is omitted.

As illustrated in FIG. 10, the control unit 45 includes an arithmetic operation unit 451, a communication-cycle detecting unit 452, and a driving control unit 453. The arithmetic operation unit 451 calculates target electric power of each of the heating units 11 to 13 on the basis of input information input from the operation unit 40*a* and indicates the target electric power to the driving control unit 453. The target electric power is a command value calculated according to a cooking menu, input heating power, or the like input from the operation unit 40*a* or the external apparatus 200 or a value changed from the command value taking into account interference with a radio signal as explained below. The driving control unit 453 generates, on the basis of the target electric power, the detection value of the electric current by the input-current detecting unit 25*a*, and the detection value of the electric current by the output-current detecting unit 25*b*, control signals for controlling ON/OFF of the switching elements of the inverter circuit 23 of the driving circuit 51 and inputs the control signals to the inverter circuit 23.

When input information indicating input heating power is input from the operation unit 40*a* and the input heating power is indicated by electric power, the arithmetic operation unit 451 sets the input heating power as the target electric power. When the input heating power is not indicated by electric power, for example, when the input heating power is indicated by strong, medium, weak, or the like, the arithmetic operation unit 451 converts the input information into electric power and sets a value obtained by the conversion as the target electric power. When the input heating power is indicated by a cooking menu, the arithmetic operation unit 451 calculates a target electric power of each of the heating units 11 to 13 according to operation information of input electric power of each of predetermined cooking menus. The operation information of the input electric power is information indicating operation for, for example, using a not-illustrated temperature sensor that detects temperatures of the first heating port 1, the second heating port 2, and the third heating port 3, setting the value of the input electric power to a first value until the temperatures of the first heating port 1, the second heating port 2, and the third heating port 3 reach a first temperature and setting the value of the input electric power to a second value after the temperatures of the first heating port 1, the second heating port 2, and the third heating port 3 reach the first temperature.

The communication-cycle detecting unit 452 determines whether wireless communication executed by the communication unit 6 has periodicity and, when the wireless communication has periodicity, calculates a cycle.

In this embodiment, in a period of time in which the communication unit 6 and the external apparatus 200 perform wireless communication, the control unit 45 performs control for changing high-frequency electric power supplied by the driving unit 50, that is, power change control. The power change control is explained below.

Figure 11:
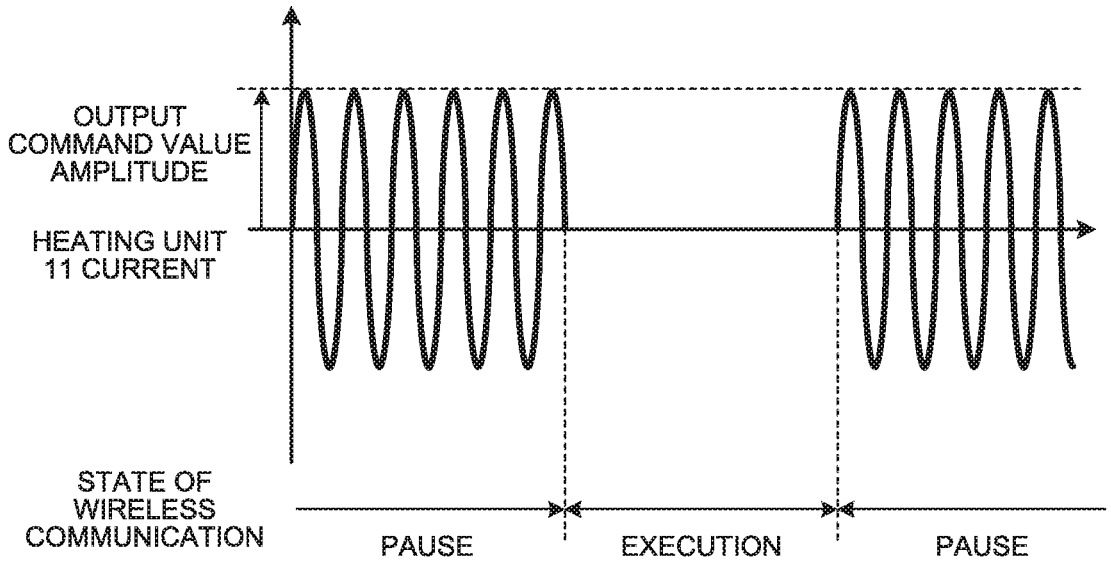
FIG. 11 is a diagram illustrating an example of a relation between high-frequency electric power supplied to a first heating unit by the driving circuit in the first embodiment and a period of time in which a communication unit performs wireless communication.

FIG. 11 is a diagram illustrating an example of a relation between high-frequency electric power supplied to the first heating unit 11 by the driving circuit 51 and a period of time in which the communication unit 6 performs wireless communication. In the following explanation, the power change control is explained with reference to the first heating unit 11 as an example. However, the same control can be performed in the second heating unit 12 and the third heating unit 13. In FIG. 11, an electric current input to the first heating unit 11 is illustrated in an upper part and a state of the wireless communication is illustrated in a lower part. A dotted line in the upper part of FIG. 11 indicates output command value amplitude, which is the amplitude of an electric current corresponding to an original command value. In the example illustrated in FIG. 11, in a period of time in which the communication unit 6 executes the wireless communication, that is, a first period, the arithmetic operation unit 451 of the control unit 45 stops high-frequency electric power supplied by the driving circuit 51. Specifically, for example, the arithmetic operation unit 451 outputs 0 as target electric power, which is a control target value different from the original command value, to the driving control unit 453. Consequently, a leaking magnetic flux generated in the first heating unit 11 is reduced and interference due to the leaking magnetic flux with a radio signal is suppressed.

Figure 12:
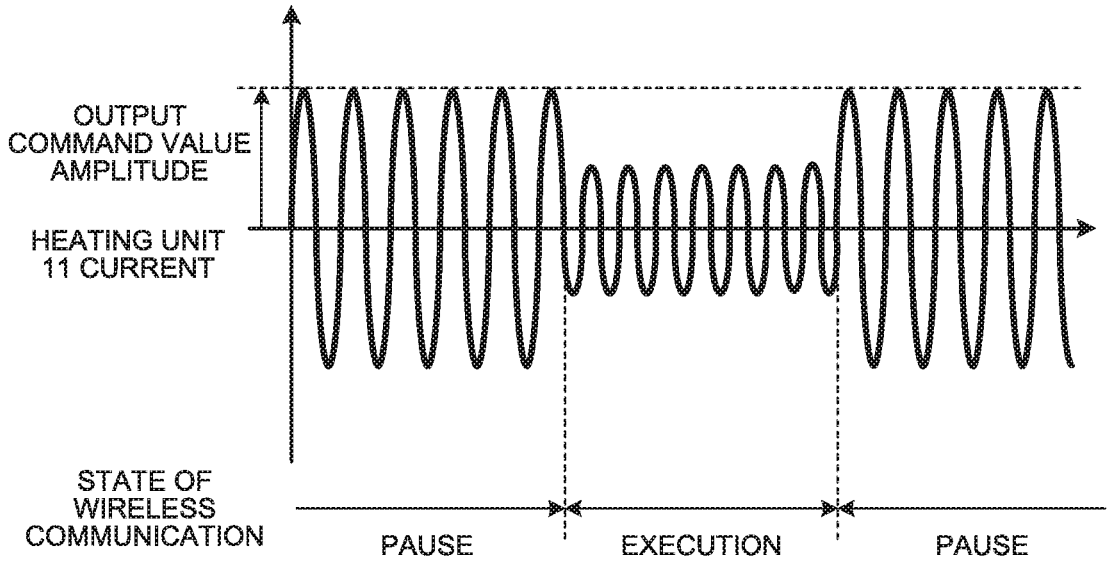
FIG. 12 is a diagram illustrating another example of the relation between the high-frequency electric power supplied to the first heating unit by the driving circuit in the first embodiment and the period of time in which the communication unit performs the wireless communication.

FIG. 12 is a diagram illustrating another example of the relation between the high-frequency electric power supplied to the first heating unit 11 by the driving circuit 51 and the period of time in which the communication unit 6 performs the wireless communication. In FIG. 12, an electric current input to the first heating unit 11 is illustrated in an upper part and a state of the wireless communication is illustrated in a lower part. A dotted line in the upper part of FIG. 12 indicates output command value amplitude, which is the amplitude of an electric current corresponding to the original command value. In the example illustrated in FIG. 12, in the period of time in which the communication unit 6 executes the wireless communication, that is, the first period, the arithmetic operation unit 451 controls the high-frequency electric power supplied by the driving circuit 51. That is, in the example illustrated in FIG. 12, in the period of time in which the communication unit 6 executes the wireless communication, that is, the first period, the high-frequency electric power supplied by the driving circuit 51 is small compared with a period of time in which the communication unit 6 does not execute the wireless communication, that is, a second period.

Specifically, for example, the arithmetic operation unit 451 designates, to the driving control unit 453, instead of the original command value, an instruction value indicating electric power that is small compared with electric power in the period of time in which the wireless communication is not executed. Consequently, it is possible to reduce a leaking magnetic flux generated in the first heating unit 11, suppress interference due to the leaking magnetic flux with a radio signal, and obtain output electric power closer to the original command value compared with when the supplied high-frequency electric power is stopped as illustrated in FIG. 11. The original command value is a command value before the output electric power is reduced to reduce the leaking magnetic flux and is, for example, a command value based on information set by the operation unit 40*a*, 40*b*, 40*c* or the external apparatus 200.

The communication-cycle detecting unit 452 determines, on the basis of signals indicating a communication start and a communication end output from the communication unit 6, whether the communication unit 6 and the external apparatus 200 have periodicity in the wireless communication. Note that, when being wirelessly connected to the external apparatus 200, the communication unit 6 outputs the signal indicating the communication start and the signal indicating the communication end to the communication-cycle detecting unit 452, respectively, at the start and the end of the communication between the communication unit 6 and the external apparatus 200. The communication-cycle detecting unit 452 stores, for example, the time of the communication start and the time of the communication end on the basis of the signals indicating the communication start and the communication end and calculates a time difference $\Delta t_1$ between communication start times from communication start times in the past. The communication-cycle detecting unit 452 calculates a plurality of $\Delta t_1$, performs statistical processing of the plurality of $\Delta t_1$, and, when a standard deviation or a dispersion is equal to or smaller than a predetermined threshold, determines that that the communication is periodic. A method of determining presence or absence of periodicity is not limited to this example.

When determining that the communication unit 6 and the external apparatus 200 are performing periodic communication, the communication-cycle detecting unit 452 calculates a cycle of the wireless communication between the communication unit 6 and the external apparatus 200 on the basis of the plurality of $\Delta t_1$. The communication-cycle detecting unit 452 calculates a time from the communication start time until the end time and calculates, on the basis of the calculated value, duration of the communication, that is, a period of time in which the wireless communication is executed in the cycle. In the cycle, a period of time excluding a period of time in which the wireless communication is executed is referred to as a period of time in which the wireless communication is not executed or a pause period of time of the wireless communication. According to the processing explained above, the communication-cycle detecting unit 452 can recognize the period of time in which the wireless communication is performed and the pause period of time of the wireless communication. The communication-cycle detecting unit 452 predicts the start time of the period of time in which the wireless communication is executed and the start time of the pause period of time of the wireless communication, and notifies the start times to the arithmetic operation unit 451.

When the predicted period of time in which the wireless communication is executed is notified, simultaneously with a start of the notified period of time in which the wireless communication is executed or immediately before the start of the notified period of time in which the wireless communication is executed, the arithmetic operation unit 451 performs the control for changing the target electric power output to the driving control unit 453, as explained above. If the command value output to the driving control unit 453 is changed after the execution of the wireless communication is detected, there is a possibility in that a leaking magnetic flux generated in the first heating unit 11 interferes with a radio signal in a period of time from the start of the wireless communication until the target electric power is changed. In this embodiment, the cycle of the wireless communication is calculated and the period of time in which the wireless communication is executed is predicted to perform the control explained above. Consequently, in the period of time in which the wireless communication is executed, it is possible to suppress the leaking magnetic flux generated in the first heating unit 11 from the beginning. Therefore, it is possible to improve communication quality.

Note that, when determining that the communication unit 6 and the external apparatus 200 do not have periodicity in the wireless communication, the communication-cycle detecting unit 452 notifies the arithmetic operation unit 451 to that effect. Every time the communication-cycle detecting unit 452 detects a start and an end of the wireless communication, the communication-cycle detecting unit 452 notifies the start and the end of the wireless communication to the arithmetic operation unit 451. When the start of the wireless communication is notified, the arithmetic operation unit 451 changes the target electric power output to the driving control unit 453. When the end of the wireless communication is notified, the arithmetic operation unit 451 resets the target electric power output to the driving control unit 453 to the original command value, that is, the target electric power before the change.

Figure 13:
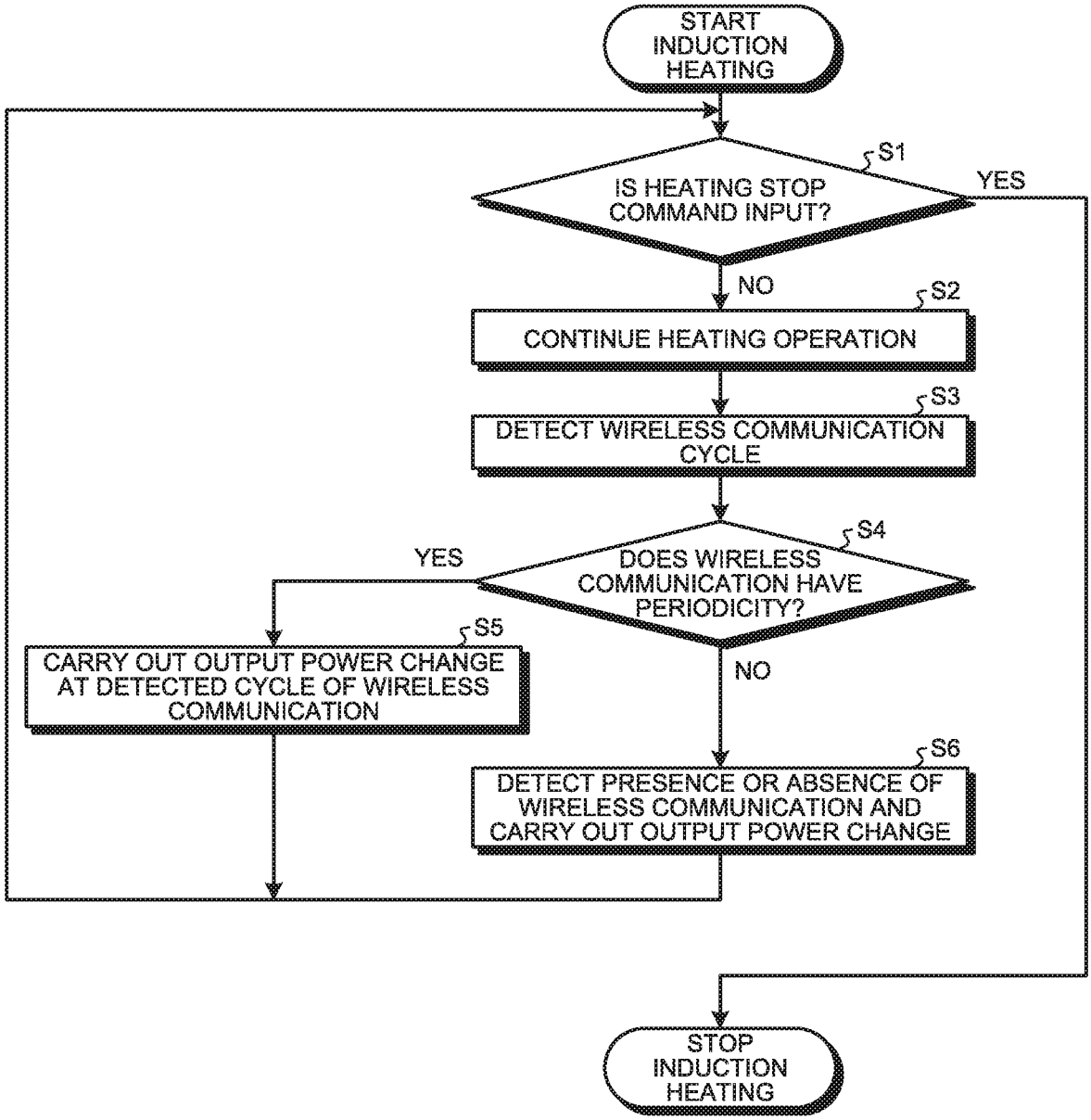
FIG. 13 is a flowchart illustrating an example of a power change control procedure in the first embodiment.

FIG. 13 is a flowchart illustrating an example of a power change control procedure in the first embodiment. FIG. 13 is a flowchart in the case in which a heating operation is carried out during communication with the external apparatus 200. First, when a start of the heating operation is instructed by operation of the operation unit 40*a*, 40*b*, 40*c* or a control signal from the external apparatus 200, the control unit 45 of the induction heating cooking apparatus 100 starts the heating operation and determines whether a heating stop command, which is information for instructing a heating stop, is input by the operation of the operation unit 40*a*, 40*b*, 40*c* or the control signal from the external apparatus 200 (step S1). When the heating stop command is input (Yes at step S1), the control unit 45 ends the heating operation.

When the heating stop command is not input (No at step S1), the induction heating cooking apparatus 100 continues the heating operation (step S2). Specifically, the control unit 45 generates target electric power on the basis of the operation of the operation unit 40*a*, 40*b*, 40*c* or the control signal from the external apparatus 200 and gives an instruction to the driving circuit 51. The driving circuit 51 inputs high-frequency electric power to the first heating unit 11. In an initial state, the target electric power is a command value.

During continuation of the heating operation, the control unit 45 detects a cycle of the wireless communication performed by the communication unit 6 and the external apparatus 200 (step S3). Specifically, the communication-cycle detecting unit 452 determines whether the wireless communication performed by the communication unit 6 and the external apparatus 200 has periodicity. When determining that the wireless communication has periodicity, the communication-cycle detecting unit 452 carries out calculation processing of a cycle and prediction processing of a period of time in which the wireless communication is executed.

When determining that the wireless communication performed by the communication unit 6 and the external apparatus 200 has periodicity (Yes at step S4), the control unit 45 performs, on the basis of prediction of a period of time in which the wireless communication is executed, control for changing high-frequency electric power supplied to the first heating unit 11 (step S5) and returns to step S1. Specifically, as explained above, on the basis of the prediction of the period of time in which the wireless communication is executed, the control unit 45 reduces the high-frequency electric power supplied to the first heating unit 11 in the period of time in which the wireless communication is executed and, in a pause period of time of the wireless communication, carries out control for restoring the high-frequency electric power.

When determining that the wireless communication performed by the communication unit 6 and the external apparatus 200 does not have periodicity (No at step S4), the control unit 45 performs control for changing the high-frequency electric power supplied to the first heating unit 11 after detecting execution of the wireless communication (step S6) and returns to step S1. As explained above, the control unit 45 can carry out the same control on each of the second heating unit 12 and the third heating unit 13.

The control unit 45 can generate a control signal for designating, to the external apparatus 200, a cycle for performing the wireless communication and transmit the control signal to the external apparatus 200 through the communication unit 6. Consequently, the control unit 45 can determine, according to a cooking mode such as preheating or heat insulation, a heating state, or the like, a cycle for performing the wireless communication between the communication unit 6 and the external apparatus 200. For example, when the object to be heated 5 is heated to a set temperature in the preheating mode, the control unit 45 transmits temperature information on the object to be heated 5 to the external apparatus 200 through the wireless communication at a relatively short cycle and informs the temperature. On the other hand, it is conceivable that, after the preheating is completed, the control unit 45 transmits the temperature information of the object to be heated 5 to the external apparatus 200 through the wireless communication at a relatively long cycle. Consequently, when frequent communication is unnecessary, it is possible to further reduce the number of times of the wireless communication and reduce the number of times the high-frequency electric power supplied by the driving unit 50 is changed. Therefore, it is possible to obtain electric power closer to the original command value.

According to the processing explained above, in a period of time in which the communication unit 6 and the external apparatus 200 do not execute the wireless communication, the driving circuit 51 can reduce or stop the high-frequency electric power supplied to the first heating unit 11. When the control for reducing or stopping the output electric power to the first heating unit 11 is performed when the wireless communication is performed, average output electric power is smaller than the command value. However, in a case where the wireless communication has periodicity, when the high-frequency electric power supplied by the driving circuit 51 in the pause period of time of the wireless communication is increased to be higher than a value corresponding to the original command value, it is possible to supply average output electric power closer to the original command value to the first heating unit 11. For example, when the original command value is represented as X and the period of time in which the wireless communication is executed is $T_a$ and the pause period of time of the wireless communication is $T_b$, the control unit 45 sets target electric power in the period of time in which the wireless communication is executed to $X-\Delta X$ and sets target electric power in the pause period of time of the wireless communication to $X+\Delta X\times T_a/T_b$.

Figure 14:
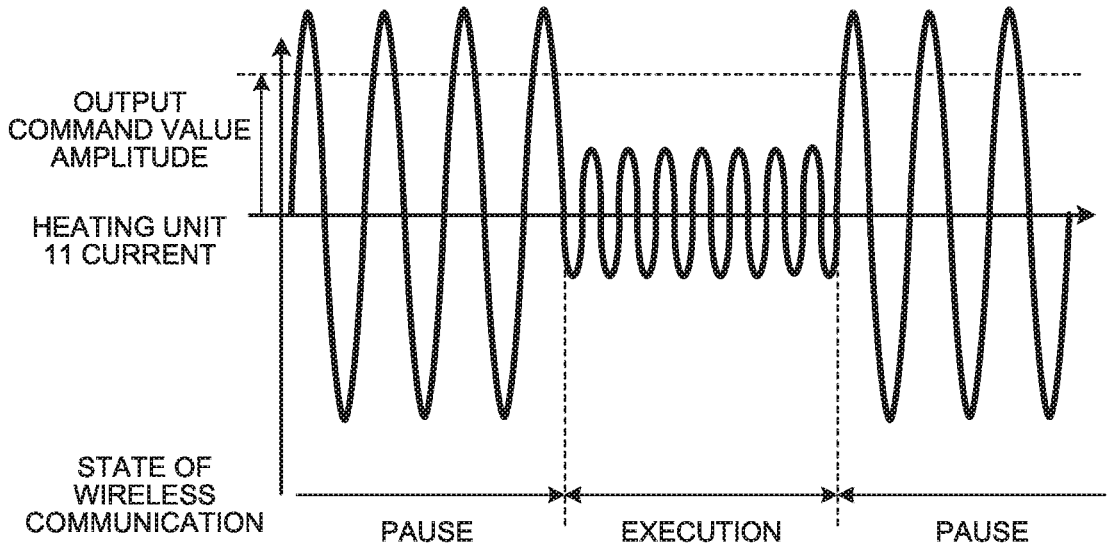
FIG. 14 is a diagram illustrating an example of high-frequency electric power supplied by the driving circuit when output electric power is increased in a pause period of time of the wireless communication in the first embodiment.

FIG. 14 is a diagram illustrating an example of the high-frequency electric power supplied by the driving circuit 51 when the output electric power is increased in the pause period of time of the wireless communication. In FIG. 14, an electric current input to the first heating unit 11 is illustrated in an upper part and a state of the wireless communication is illustrated in a lower part. A dotted line in the upper part of FIG. 14 indicates output command value amplitude, which is the amplitude of an electric current corresponding to the original command value. In the example illustrated in FIG. 14, the driving circuit 51 outputs high-frequency electric power smaller than the original command value in the period of time in which the wireless communication is performed. On the other hand, in the period of time in which the wireless communication is not performed, the driving circuit 51 can supply average output electric power closer to the command value to the first heating unit 11 by outputting high-frequency electric power equal to or larger than the command value. Note that FIG. 14 illustrates a case in which the high-frequency electric power supplied by the driving circuit 51 is changed by switching frequency control.

When determining that the wireless communication is not accurately performed at specific output electric power set via the operation units 40*a* to 40*c*, irrespective of presence or absence of periodicity of the wireless communication, the control unit 45 performs control for repeating a reduction and an increase of the output electric power from the driving circuit 51 and obtaining average output electric power close to the command value. In the switching frequency control, the frequency of the high-frequency electric current is determined by the output electric power from the driving circuit 51. Therefore, by performing the control for repeating an increase and a reduction of the output electric power, it is possible to change the frequency of the high-frequency electric current flowing to the first heating unit 11. Consequently, when a leaking magnetic flux having a specific frequency interferes with a wireless communication signal, it is possible to operate at a frequency for not causing interference and supply average output electric power closer to the command value to the heating coils.

The determination that the wireless communication is accurately performed is carried out, for example, by the following method. When a radio signal is transmitted from the external apparatus 200 to the communication unit 6, the communication unit 6 transmits a signal for confirming content of a received control signal to the external apparatus 200. The external apparatus 200 transmits, from the received signal, a signal concerning whether the control signal is correctly received in the communication unit 6 to the communication unit 6 again. Consequently, the communication unit 6 can confirm whether the wireless communication is accurately performed. The communication unit 6 notifies information indicating whether the wireless communication is accurately performed to the control unit 45. The control unit 45 can determine on the basis of the notification whether the wireless communication is accurately performed. Alternatively, as an opposite case, when a control signal is transmitted from the communication unit 6 to the external apparatus 200, a signal for confirming content of the received control signal is transmitted from the external apparatus 200 to the communication unit 6. The communication unit 6 confirms, from the received signal, whether the control signal is correctly received in the external apparatus 200. There is a method described as above. Alternatively, both of these methods can be carried out.

As another method of determining that the wireless communication is accurately performed, there is also a method of defining in advance a form of a control signal wirelessly communicated between the external apparatus 200 and the communication unit 6 and determining, according to whether the received control signal is in the correct form, whether the wireless communication is accurately performed.

Besides, as another method of determining that the wireless communication is accurately performed, there is also a method of adding sings serving as marks of wireless communication success at least in start and end parts of a control signal communicated between the external apparatus 200 and the communication unit 6 and determines, according to whether the control signal including all the marks can be received, whether the wireless communication is accurately performed. The method of determining that the wireless communication is accurately performed is not limited to the examples explained above. Any method can be used.

As explained above, the induction heating cooking apparatus 100 in this embodiment determines presence or absence of periodicity of the wireless communication, when there is periodicity, calculates the period of time in which the wireless communication is executed and the period of time in which the wireless communication is not executed, and sets the electric power supplied to the first heating unit 11 smaller in the period of time in which the wireless communication is executed than in the period of time in which the wireless communication is not executed. Consequently, the induction heating cooking apparatus 100 can suppress interference due to a leaking magnetic flux with a radio signal transmitted or received between the induction heating cooking apparatus 100 and the external apparatus 200.

Second Embodiment

Figure 15:
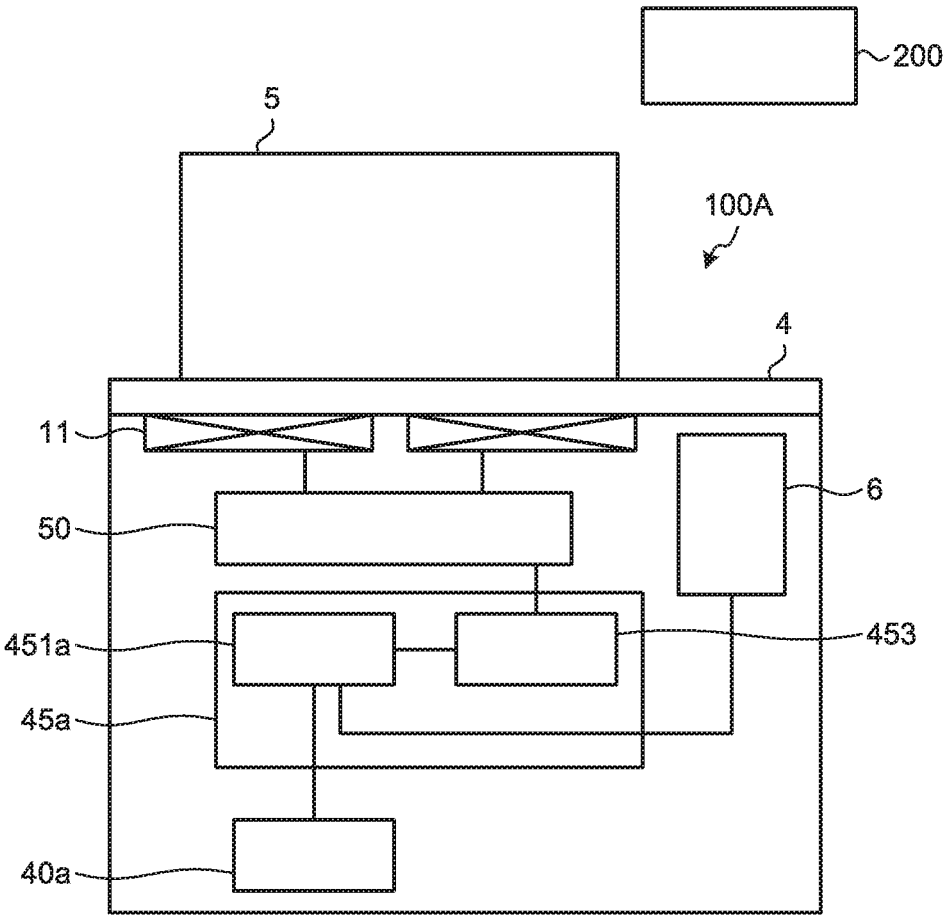
FIG. 15 is a diagram illustrating a configuration example of a control unit of an induction heating cooking apparatus according to a second embodiment.

FIG. 15 is a diagram illustrating a configuration example of a control unit 45*a* of an induction heating cooking apparatus 100A according to a second embodiment of the present invention. The induction heating cooking apparatus 100A in this embodiment is the same as the induction heating cooking apparatus 100 in the first embodiment except that the induction heating cooking apparatus 100A includes the control unit 45*a* instead of the control unit 45 in the first embodiment. The control unit 45*a* includes an arithmetic operation unit 451*a* and the same driving control unit 453 same as the driving control unit 453 in the first embodiment. Components having the same functions as the functions in the first embodiment are denoted by the same reference numerals and signs. Redundant explanation of the components is omitted. Differences from the first embodiment are explained below.

The magnitude of a leaking magnetic flux generated from the first heating unit 11 pulsates at a double frequency of the frequency of alternating-current electric power supplied from the alternating-current power supply circuit 21. In this embodiment, control for executing wireless communication is performed in a period of time near a trough of this pulsation.

Figure 16:
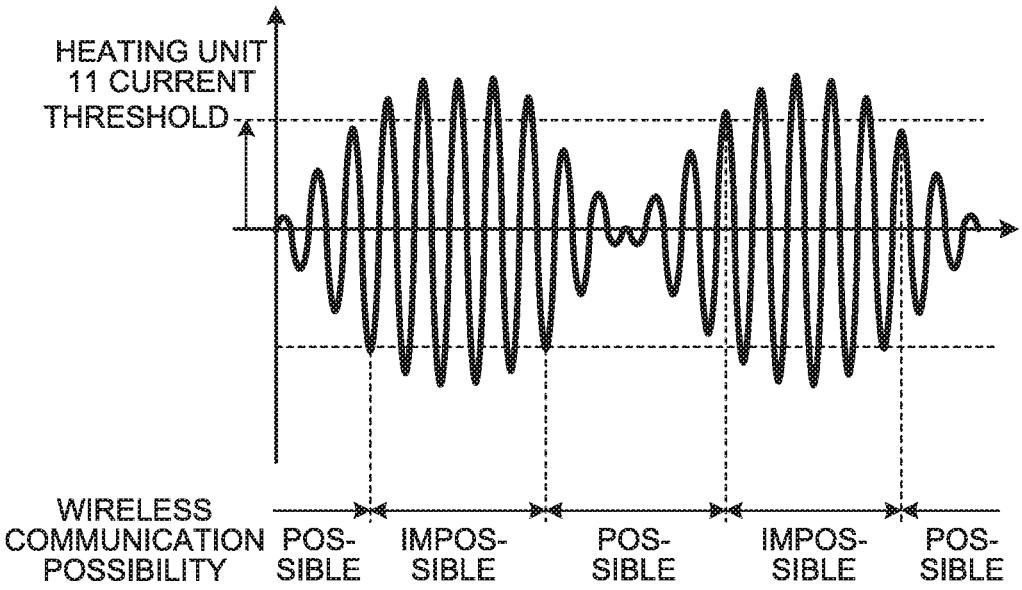
FIG. 16 is a diagram illustrating an example of a relation between high-frequency electric power supplied by a driving circuit in the second embodiment and a period of time in which a communication unit performs wireless communication.

FIG. 16 is a diagram illustrating an example of a relation between high-frequency electric power supplied by the driving circuit 51 and a period of time in which the communication unit 6 performs the wireless communication, in the second embodiment. When an output voltage of the direct-current power supply circuit 22 is not completely smoothed, an electric current supplied to the first heating unit 11 by the driving circuit 51 pulsates at a double frequency of the frequency of the alternating-current electric power supplied from the alternating-current power supply circuit 21. Therefore, the magnitude of the leaking magnetic flux generated in the first heating unit 11 also pulsates at the double frequency of the frequency of the alternating-current electric power supplied from the alternating-current power supply circuit 21. The double frequency of the frequency of the alternating-current electric power supplied from the alternating-current power supply circuit 21 is hereinafter referred to as power supply double frequency.

The induction heating cooking apparatus 100A measures an electric current of the first heating unit 11 with the output-current detecting unit 25*b* and performs wireless communication in a period of time in which a peak current of the first heating unit 11 that pulsates at the power supply double frequency is within a predetermined current range, that is, the amplitude of the electric current is equal to or smaller than a predetermined threshold. The peak current of the first heating unit 11 indicates a maximum in each switching cycle of the electric current output to the first heating unit 11. As illustrated in FIG. 16, the peak current pulsates at the power supply double frequency. By performing the wireless communication in the period of time in which the peak current of the first heating unit 11 is equal to or smaller than the threshold, it is possible to perform the wireless communication in a period of time in which a leaking magnetic flux generated in the first heating unit 11 is less. Therefore, it is possible to suppress the leaking magnetic flux generated in the first heating unit 11 from interfering with the radio signal and improve the quality of the wireless communication. The maximum of the peak current of the first heating unit 11 is larger as the command value of the output electric power is larger. However, because the period of time in which the wireless communication is performed is set to the period of time in which the peak current of the first heating unit 11 is in the current range, it is possible to perform, irrespective of the command value of the output electric power, the wireless communication in the period of time in which the leading magnetic flux generated in the first heating unit 11 is less.

Figure 17:
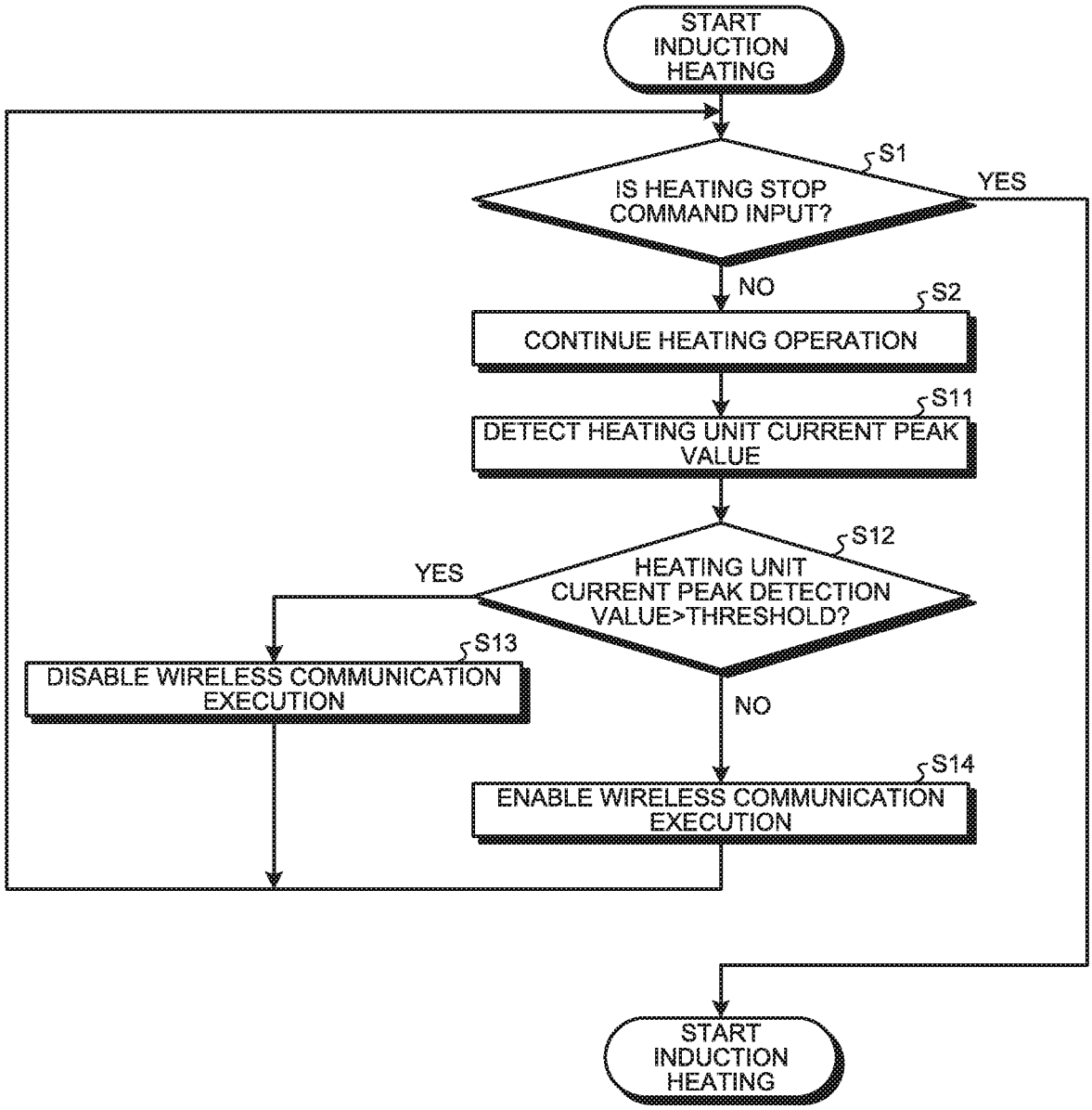
FIG. 17 is a flowchart illustrating an example of a communication control procedure in the second embodiment.

FIG. 17 is a flowchart illustrating an example of communication control procedure in this embodiment. Step S1 and step S2 are respectively the same as step S1 and step S2 in the first embodiment. When a heating operation is continued, the arithmetic operation unit 451*a* detects, on the basis of a detection value of an electric current by the output-current detecting unit 25*b*, a peak current of the first heating unit 11, that is, a peak value of an electric current input to the first heating unit 11 (step S11). The arithmetic operation unit 451*a* determines whether the peak current of the first heating unit 11 exceeds the threshold (step S12). When the peak current exceeds the threshold (Yes at step S12), the arithmetic operation unit 451*a* determines that wireless communication execution is impossible (step S13), notifies prohibition of the wireless communication to the communication unit 6, and returns to step S1. When the peak current of the first heating unit 11 is equal to or smaller than the threshold (No at step S12), the arithmetic operation unit 451*a* determines that the wireless communication execution is possible (step S14), notifies permission of the wireless communication to the communication unit 6, and returns to step S1.

The peak current of the first heating unit 11 is desirably calculated by measuring an electric current directly output to the first heating unit 11. However, as means for estimating the peak current of the first heating unit 11 instead of measuring the electric current of the first heating unit 11, means for estimating, using an input electric current detected by the input-current detecting unit 25*a*, the peak current from a period of time in which the input electric current is within a predetermined current range may be used. For example, instead of the period of time in which the electric current output to the first heating unit 11 is equal to or smaller than the threshold, a period of time in which the input electric current detected by the input-current detecting unit 25*a* is within the predetermined current range can be used.

As another means for estimating the period of time in which the peak current of the first heating unit 11 is equal to or smaller than the threshold, means for measuring an input voltage of the direct-current power supply circuit 22 or an output voltage of the direct-current power supply circuit 22 using a voltage detecting unit such as a voltage sensor and estimating a period of time in which the peak current of the first heating unit 11 is equal to or smaller than the threshold using a period of time in which the input voltage or the output voltage is within a predetermined voltage range may be used. For example, instead of the period of time in which the electric current output to the first heating unit 11 is equal to or smaller than the threshold, a period of time in which the input voltage or the output voltage is within the predetermined voltage range can be used.

As another means for estimating the period of time in which the peak current of the first heating unit 11 is equal to or larger than the threshold, means for measuring a magnetic flux generated in the first heating unit 11 using a magnetic-flux detecting unit such as a Hall sensor and estimating a period of time in which the peak current of the first heating unit 11 is equal to or smaller than the threshold using a period of time in which the magnetic flux is equal to or smaller than a predetermined threshold may be used. In this case, it is desirable to dispose the Hall sensor near the communication unit 6. For example, instead of the period of time in which the electric current output to the first heating unit 11 is equal to or smaller than the threshold, a period of time in which the magnetic flux is equal to or smaller than the threshold can be used.

As explained above, in this embodiment, communication is permitted in the period of time in which the peak current of the first heating unit 11 is equal to or smaller than the threshold and communication is disabled when the peak current of the first heating unit 11 is larger than the threshold. Therefore, the induction heating cooking apparatus 100A can suppress interference due to a leaking magnetic flux with a radio signal transmitted or received between the induction heating cooking apparatus 100A and the external apparatus 200.

As explained above, in the first embodiment, the period of time in which the wireless communication is executed and the pause period of time of the wireless communication are predicted. In the period of time in which the wireless communication is executed, the control is performed to set the electric power output from the driving circuit 51 to the first heating unit 11 to be smaller than the electric power output from the driving circuit 51 to the first heating unit 11 in the pause period of the wireless communication. On the other hand, in the second embodiment, control is performed to permit communication in the period of time in which the peak current of the first heating unit 11 is equal to or smaller than the threshold and disable the communication when the peak current of the first heating unit 11 is larger than the threshold. In the second embodiment, the peak current of the first heating unit 11 is smaller in the period of time in which the communication is permitted, that is, the wireless communication is executed than in the period of time in which the communication is disabled, that is, the pause period of time of the wireless communication. Therefore, in the second embodiment, in the period of time in which the wireless communication is executed, electric power output from the driving circuit 51 to the first heating unit 11 is smaller than electric power output from the driving circuit 51 to the first heating unit 11 in the pause period of the wireless communication. Note that the function of the communication control explained in the second embodiment can be added to the induction heating cooking apparatus 100 in the first embodiment to carry out both of the operation in the first embodiment and the operation in the second embodiment.

It is assumed that there are a plurality of heating units, the induction heating cooking apparatus 100 includes a plurality of driving circuits respectively corresponding to the heating units, and the driving circuits simultaneously operate. In this case, when the communication unit 6 and the external apparatus 200 perform the wireless communication, the control unit 45 in the first embodiment performs control for changing high-frequency electric power supplied to a part or all of first heating units 11 to reduce leaking magnetic fluxes generated in a part or all of the heating units. Alternatively, the control unit 45*a* in the second embodiment performs the communication control on a part or all of the first heating units 11 to reduce leaking magnetic fluxes generated in a part or all of the first heating units 11. Consequently, it is possible to suppress interference of leading magnetic fluxes generated in the heating units with a radio signal.

In the explanation in the first embodiment and the second embodiment, the external apparatus 200 is the smartphone. However, the external apparatus 200 is not particularly limited to this. The external apparatus 200 can be, for example, a remote controller, an information terminal such as a tablet terminal, a household electric appliance, or a home energy management system (HEMS) controller for controlling the household electric appliance and only has to be an apparatus having a wireless communication function such as WiFi (registered trademark) or Bluetooth (registered trademark).

The configurations explained in the embodiments above indicate examples of content of the present invention. The configurations can be combined with other publicly-known technologies. A part of the configurations can be omitted or changes in a range not separating from the spirit of the present invention.

The invention claimed is:

1. An induction heating cooking apparatus capable of performing wireless communication with an external apparatus, the induction heating cooking device used for heating an object to be heated, the induction heating cooking device comprising:

a heating unit to inductively heat the object to be heated;

a driving circuit to output electric power to the heating unit; and a controller to perform control for setting the electric power output from the driving circuit to a value smaller than a command value in a first period and to perform control for setting the electric power output from the driving circuit to a value larger than the command value in a second period, and wherein the first period is a period of time in which the wireless communication with the external apparatus is performed, and the second period is a period of time in which the wireless communication with the external apparatus is not performed.

2. The induction heating cooking apparatus according to claim 1, wherein the controller determines a cycle of the wireless communication between the induction heating cooking apparatus and the external apparatus on a basis of at least one of a cooking mode and a heating state and transmits, to the external apparatus, a control signal for instructing the external apparatus to perform communication at the determined cycle.

3. The induction heating cooking apparatus according to claim 1, wherein the driving circuit includes an inverter circuit, and the induction heating cooking apparatus further comprises:

an input-current detecting unit to detect the electric current input to the driving circuit; and wherein the controller sets a period of time in which the electric current detected by the input-current detecting unit is within a predetermined current range as the first period, and sets a period of time in which the electric current exceeds the predetermined current range as the second period.

4. The induction heating cooking apparatus according to claim 1, wherein the driving circuit includes a direct-current power supply circuit and an inverter circuit that is connected to the direct-current power supply circuit, and the controller sets a period of time in which a voltage input to the direct-current power supply circuit or a voltage output from the direct-current power supply circuit is within a predetermined voltage range as the first period, and sets a period of time in which the voltage input to the direct-current power supply circuit or the voltage output from the direct-current power supply circuit exceeds the predetermined voltage range as the second period.

5. The induction heating cooking apparatus according to claim 1, further comprising a controller to set a period of time in which a magnetic flux generated in the heating unit is equal to or smaller than a threshold as the first period, and set a period of time in which the magnetic flux generated in the heating unit exceeds the threshold as the second period.

6. The induction heating cooking apparatus according to claim 1, wherein the induction heating cooking apparatus receives a control signal for setting at least one of input heating power and a cooking menu of the induction heating cooking apparatus from the external apparatus as a radio signal.

7. The induction heating cooking apparatus according to claim 6, wherein the induction heating cooking apparatus controls, on a basis of the control signal received from the external apparatus, the electric power output to the heating unit by the driving circuit.

8. The induction heating cooking apparatus according to claim 1, wherein the induction heating cooking apparatus transmits, as a radio signal, at least any of information indicating an operation state of the induction heating cooking apparatus, setting information for the induction heating cooking apparatus, and information based on a control signal received from the external apparatus.

9. The induction heating cooking apparatus according to claim 1, further comprising a display unit to display at least one of information indicating an operation state of the induction heating cooking apparatus, setting information for the induction heating cooking apparatus, information based on a control signal received from the external apparatus, and information indicating a communication state between the induction heating cooking apparatus and the external apparatus.

10. The induction heating cooking apparatus according to claim 1, wherein the external apparatus is at least one of an information communication terminal, a remote controller for operating the induction heating cooking apparatus, a household electric appliance, and a home energy management system controller.

11. An induction heating cooking apparatus capable of performing wireless communication with an external apparatus, the induction heating cooking device used for heating an object to be heated, the induction heating cooking device comprising:

a heating unit to inductively heat the object to be heated;

a driving circuit to output electric power to the heating unit; and a controller to, when wireless communication is periodically performed between the induction heating cooking apparatus and the external apparatus, calculate a cycle of the wireless communication between the induction heating cooking apparatus and the external apparatus, predict a first period and a second period on a basis of the cycle, and change, on a basis of a result of the prediction, the electric power output from the driving circuit, wherein electric power output from the driving circuit during the first period is less than electric power output from the driving circuit during the second period, the first period being a period of time in which wireless communication with the external apparatus is performed, and the second period being a period of time in which wireless communication with the external apparatus is not performed.

12. The induction heating cooking apparatus according to claim 11, wherein the controller performs control for setting the electric power output from the driving circuit to a value smaller than a command value in the first period.

13. The induction heating cooking apparatus according to claim 11, wherein the controller determines a cycle of the wireless communication between the induction heating cooking apparatus and the external apparatus on a basis of at least one of a cooking mode and a heating state and transmits, to the external apparatus, a control signal for instructing the external apparatus to perform communication at the determined cycle.

14. An induction heating cooking apparatus capable of performing wireless communication with an external apparatus, the induction heating cooking apparatus used for heating an object to be heated, the induction heating cooking apparatus comprising:

a heating unit to inductively heat the object to be heated;

a driving circuit to output electric power to the heating unit, the driving circuit including switching elements;

a controller to control the driving circuit with switching frequency control and, when detecting that communication is not accurately performed when a switching frequency in the switching frequency control is a specific frequency, control the driving circuit such that the electric power output to the heating unit repeats an increase and a decrease.

15. An induction heating cooking apparatus capable of performing wireless communication with an external apparatus, the induction heating cooking apparatus used for heating an object to be heated, the induction heating cooking apparatus comprising:

a heating unit to inductively heat the object to be heated;

a driving circuit to output electric power to the heating unit, the driving circuit including an inverter circuit;

an output-current detecting unit to detect the electric current output from the driving circuit to the heating unit; and a controller to set a period of time in which a maximum in a switching cycle of the inverter circuit of the electric current detected by the output-current detecting unit is equal to or smaller than a threshold as a period of time in which the induction heating cooking apparatus executes the wireless communication with the external apparatus, and set a period of time in which the maximum exceeds the threshold as a period of time in which the wireless communication with the external apparatus is not performed.

16. An induction heating cooking apparatus capable of performing wireless communication with an external apparatus, the induction heating cooking apparatus used for heating an object to be heated, the induction heating cooking apparatus comprising:

a plurality of heating units to inductively heat the object to be heated; and a plurality of driving circuits to correspondingly output electric power to the plurality of heating units, wherein at least one driving circuit among the plurality of driving circuit outputs, in a first period, electric power less than electric power output in a second period, and the first period is a period of time in which the wireless communication with the external apparatus is performed, and the second period is a period of time in which the wireless communication with the external apparatus is not performed.

* * * * *